US007128616B1

(12) United States Patent
Orr et al.

(10) Patent No.: US 7,128,616 B1
(45) Date of Patent: Oct. 31, 2006

(54) HIGH SPEED DATA TRANSMISSION CABLE CONNECTOR SYSTEM

(75) Inventors: Lawrence William Orr, Simpsonville, SC (US); Dennis Whitacre, Rancho Cucamonga, CA (US)

(73) Assignees: Woven Electronics Corporation, Simpsonville, SC (US); Deutsch ECD Defense/Aerospace Operations, Hemet, CA (US)

( * ) Notice: Subject to any disclaimer, the term of this patent is extended or adjusted under 35 U.S.C. 154(b) by 0 days.

(21) Appl. No.: 11/203,753

(22) Filed: Aug. 15, 2005

(51) Int. Cl.
*H01R 33/94* (2006.01)

(52) U.S. Cl. ..... 439/651; 439/655; 439/579

(58) Field of Classification Search ..... 439/650–655, 439/579, 564
See application file for complete search history.

(56) References Cited

U.S. PATENT DOCUMENTS

| | | | | |
|---|---|---|---|---|
| 2,265,341 | A | 12/1941 | Borchert | |
| 3,629,789 | A | 12/1971 | Szeremy | |
| 3,745,515 | A * | 7/1973 | Michaels | 439/651 |
| 3,897,131 | A * | 7/1975 | Stauffer | 439/655 |
| 4,519,661 | A | 5/1985 | Brush et al. | |
| RE31,995 | E | 10/1985 | Ball | |
| 4,653,839 | A * | 3/1987 | Powell | 439/660 |
| 4,904,208 | A * | 2/1990 | Powell et al. | 439/654 |
| 5,071,370 | A * | 12/1991 | Kochan, Jr. | 439/620 |
| 5,092,791 | A * | 3/1992 | Contarino | 439/365 |
| 5,443,389 | A * | 8/1995 | Hughes | 439/35 |
| 5,551,882 | A * | 9/1996 | Whiteman et al. | 439/21 |
| 5,564,950 | A * | 10/1996 | Loman et al. | 439/651 |
| 5,618,204 | A | 4/1997 | Nix et al. | |
| 6,152,753 | A | 11/2000 | Johnson et al. | |
| 6,869,321 | B1 * | 3/2005 | Ashby et al. | 439/851 |
| 7,008,248 | B1 * | 3/2006 | Kondas et al. | 439/211 |

* cited by examiner

*Primary Examiner*—Gary F. Paumen
(74) *Attorney, Agent, or Firm*—McNair Law Firm,PA; Cort Flint

(57) ABSTRACT

A connector assembly is disclosed for interconnecting high speed data transmission cables across an interface panel to an external circuit. A first pin array of conductive pins is carried by an input face and a corresponding second pin array of conductive pins is carried by an output face of a panel connector. An array of conductive sockets corresponding to the second pin array is carried by a plug front of a plug connector for receiving the second array of pins when connectors are mated together. A third pin array of conductive pins is carried by plug back corresponding to the first pin array. In this manner, a first set of transmission cables electrically connected to the first pin array of the panel connector is electrically connected to a second set of transmission cables connected to the third pin array of the plug connector.

22 Claims, 8 Drawing Sheets

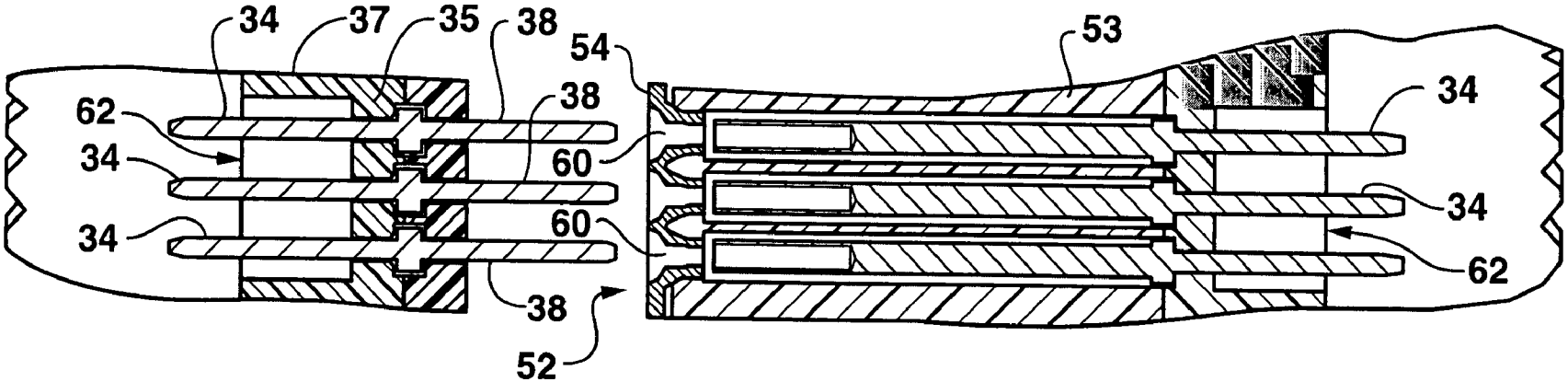
FIG. 8A
FIG. 8B
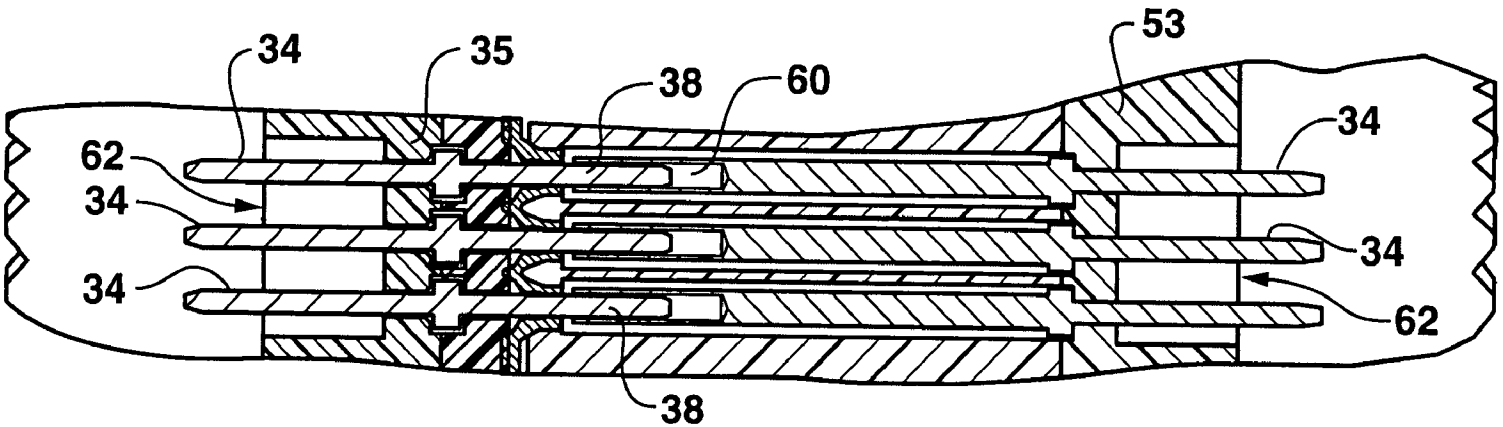
FIG. 9

HIGH SPEED DATA TRANSMISSION CABLE CONNECTOR SYSTEM

BACKGROUND OF THE INVENTION

The invention relates to high speed data transmission cables and connectors use in avionics, and, particularly, to a connector designed to meet the needs of original equipment manufacturers (OEM) for higher density packing, lower profiles, modular designs, low cost solutions and ease of use and reparability.

Typically the high speed transmission cables include shielded parallel pair cables or various types of coax cables. Typically these data transmission cables are terminated at connector assemblies using coax or special contacts. The connector assemblies include connector receptacles made according to military specifications. For example, in electronic enclosures, panel connectors are used to interconnect the signals originating inside an enclosure and to other avionic boxes. MIL-C-38999 connectors are popular connectors used widely in the military and aerospace avionics applications. These connectors have typically used a variety of sizes of different coaxial contacts. However, the coaxial contacts are expensive, labor intensive, and limited in the number that can be provided within a specified connector shell size.

The prior cables and connectors used in avionic systems have the shortcomings that they are limited in the number of cables that can be accommodated due to the physical size of the connectors, and the coaxial contacts used make the connectors expensive.

SUMMARY OF THE INVENTION

The above problems are overcome according to the present invention by providing a connector assembly for interconnecting high speed data transmission cables across an interface panel to transmit data signals from an internal circuit to an external circuit comprising an electrical panel connector adapted for mounting to the panel and a mating electrical plug connector. The panel connector has a first pin face for being disposed on a first side of the panel and a post face for being disposed on a second side of the panel when mounted. A first pin array of conductive square pins is carried by the first pin face of the panel connector, and a corresponding post array of conductive round posts is carried by the post face of the panel connector. The electrical plug connector, mating with the panel connector, has a plug front and a plug back. The plug front has an array of conductive post sockets corresponding to the array of round posts for receiving the posts when the post face of the panel connector and the plug front of the plug connector are mated together, The plug back has a second pin array of the conductive square pins in electrical contact with the post sockets, the second pin array corresponds to the first pin array so that a first set of transmission cables electrically connected to the first pin array of the panel connector is electrically connected to a second set of transmission cables connected to the second pin array of the plug connector when the panel and plug connectors are mated. In this manner, high speed transmission data may be transmitted across the panel to the external circuit by means of the first and second sets of transmission cables.

Advantageously, a first cable assembly includes the first set of transmission cables wherein each cable has an end terminated at a first cable connector which mates with a group of square pins in the first pin array. second cable assembly includes the second set of transmission cables wherein each cable has an end terminated at a second cable connector which mates with a group of square pins in the second pin array. The groups of square pins correspond in position to interconnect corresponding conductors of the first and second set of cables. Each cable of the first set of transmissions cables includes a third cable connector terminating an opposite end of the cable to the internal circuit, and each cable of the second set of cables includes a fourth cable connector terminating an opposite end of the cable to the external circuit.

In an advantageous aspect of the invention, the first and second set of cables include 2 millimeter (2 mm) cables and the first, second, third, and fourth cable connectors include 2 mm cable connectors. Each of the 2 mm transmission cables of the first and second sets includes first and second conductors. The first and second conductors include a pair of parallel wires and a common ground terminated by the cable connector. Each cable 2 mm connector includes a first pair of sockets for terminating the pair of wires of the first conductor, a second pair of sockets for terminating the pair of wires of the second conductors, and a ground socket for terminating the common grounds of the conductors.

In another aspect of the invention, the square pins of the first pin array and the round post in the post array are formed as one piece in the panel connector. The square pins in the second pin array and the sockets of the socket array are formed as one piece within the plug connector. The panel connector includes a mounting flange for mounting the panel connector to the panels. The panel connector includes a threaded collar integral with the mounting flange, and the plug connector includes a threaded coupling which threadably mates with the threaded collar to fasten the panel connector and plug connector together when mated.

In accordance with the invention, a method of transmitting high speed data signals from an internal circuit across an interface panel to an external electrical circuit includes using 2 mm transmission cable assemblies composed of 2 mm cables terminated at one end by 2 mm cable connectors. The method comprises connecting a first set of the 2 mm cable assemblies to a first pin array of square pins carried by an electrical panel connector mounted to the panel wherein the first pin array is disposed on one side of the panel, and connecting a second set of 2 mm cable assemblies to a second pin array of square pins carried by a plug connector mated to the panel connector on an opposing side of the pane. The first and second pin arrays correspond to each other. Finally, the method includes terminating opposing ends of the first and second sets of 2 mm cable assemblies to the internal and external electrical circuits, respectively.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIGS. 8A and 8B are partial sectional views of the panel connector assembly wherein the panel connector and the plug connector are separated;

FIG. 9 is the sectional view of FIGS. 8A and 8B with the panel connector and plug connector mated;

DESCRIPTION OF A PREFERRED EMBODIMENT

Referring now in more details to the drawings, the invention will now be described in more detail.

Figure 1:
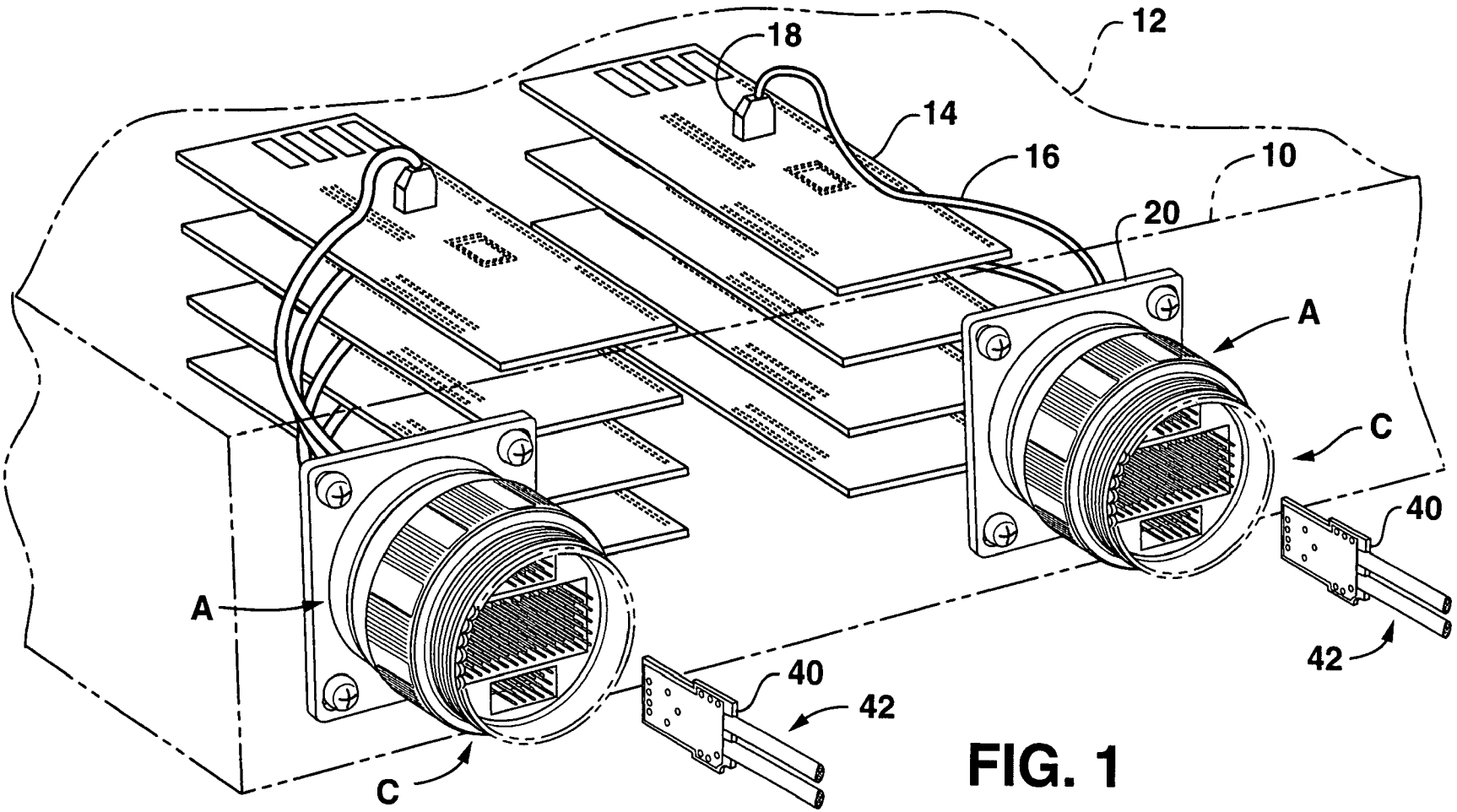
FIG. 1 is a perspective view illustrating a pair of panel connector assemblies according to the invention connecting a first set of 2 mm cables on one side of a panel to a second set of 2 mm cables on another side of the panel.

As can best be seen in FIG. 1, two connector assemblies, each designated generally as A, are illustrated mounted to a wall panel 10. In the illustrated embodiment, panel 10 is a wall of a boxlike structure enclosing a plurality of printed circuit boards 14. Wire-wrapped pins of the printed circuit boards are connected to rows of 2 mm cable connectors 40 arranged side-by-side in a back shell 16. The cables are connected at their opposing ends to a connector assembly A. While the illustrated embodiment is shown as a boxlike structure, panel 10 may be any partition, plate, bulkhead, or any other similar structure across which, or through which, electrical data signals must be transmitted. For example, a connector assembly A may be mounted on a panel of an aircraft. For this purpose, it can be seen that a mounting flange 20 is provided for mounting the connector assembly to panel 10.

Figure 2:
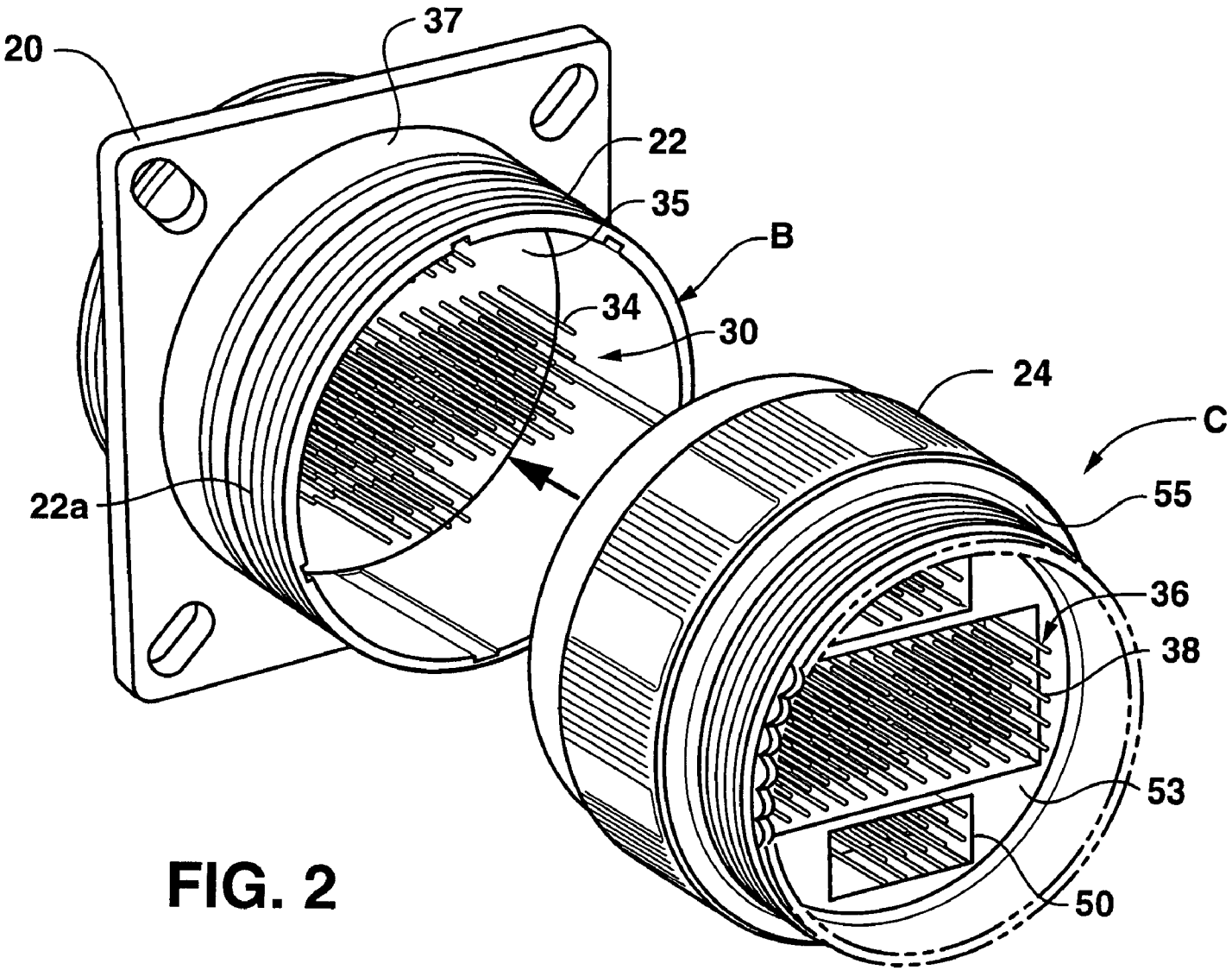
FIG. 2 is a front perspective view of a connector assembly constructed according to the invention having a panel connector and a plug connector separated from one another.
Figure 7:
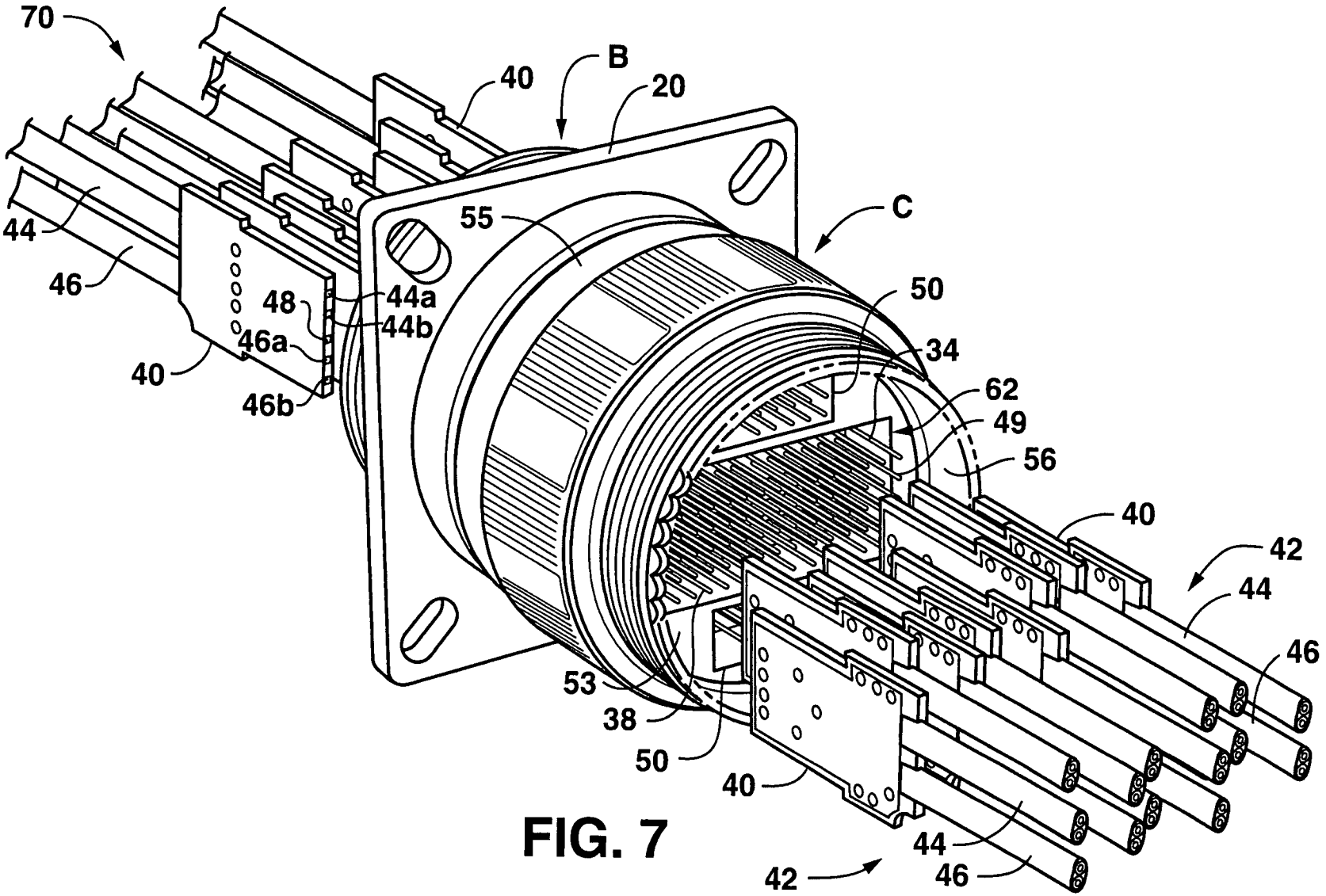
FIG. 7 is perspective view of a connector assembly according to the invention wherein a panel connector and a plug connector are mated together for interconnecting high speed data transmission cables on opposite sides of a panel.

Referring now to FIGS. 2 and 7, it can be seen that connector assembly A includes a panel connector, designated generally as B, and a plug connector, designated generally as C, which are mated together and locked in place by means of threads 22 formed on the panel connector and a threaded locking ring 24 carried on the plug connector, which can be tighten together.

Figure 3A:
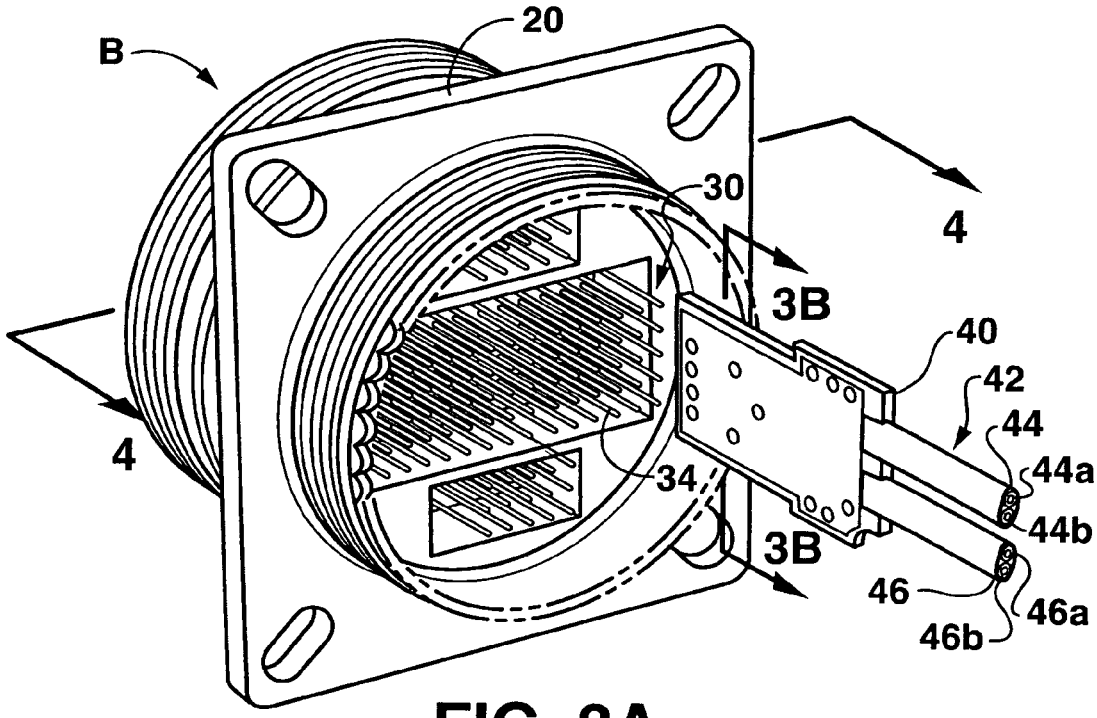
FIG. 3A is a front perspective view of the panel connector of FIG. 2.
Figure 3B:
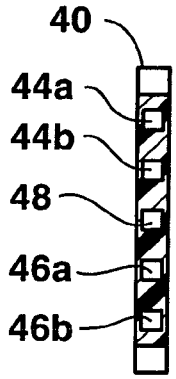
FIG. 3B is a front elevation of a cable connector for use in a connector assembly according to the invention.
Figure 4:
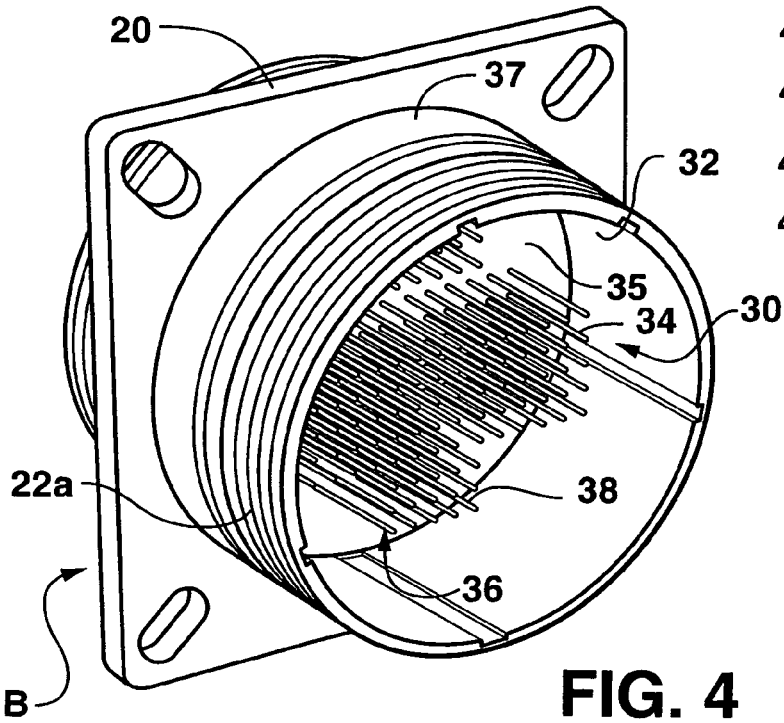
FIG. 4 is a rear perspective of the panel connector of FIG. 2.
Figure 6:
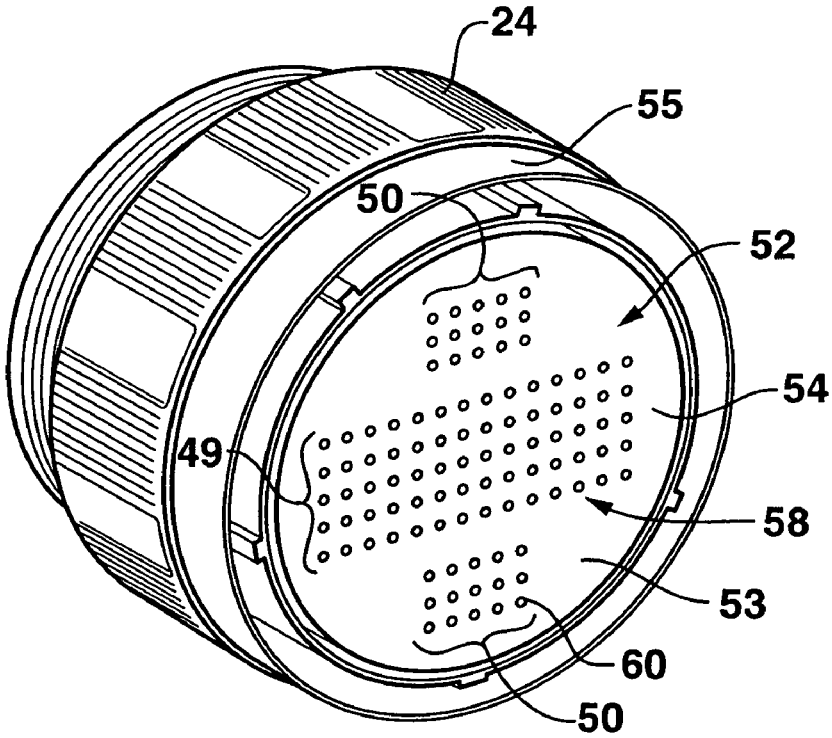
FIG. 6 is a rear perspective view of a plug front of the plug connector of FIG. 5 illustrating a socket front having an array of sockets according to the invention.
Figure 10:
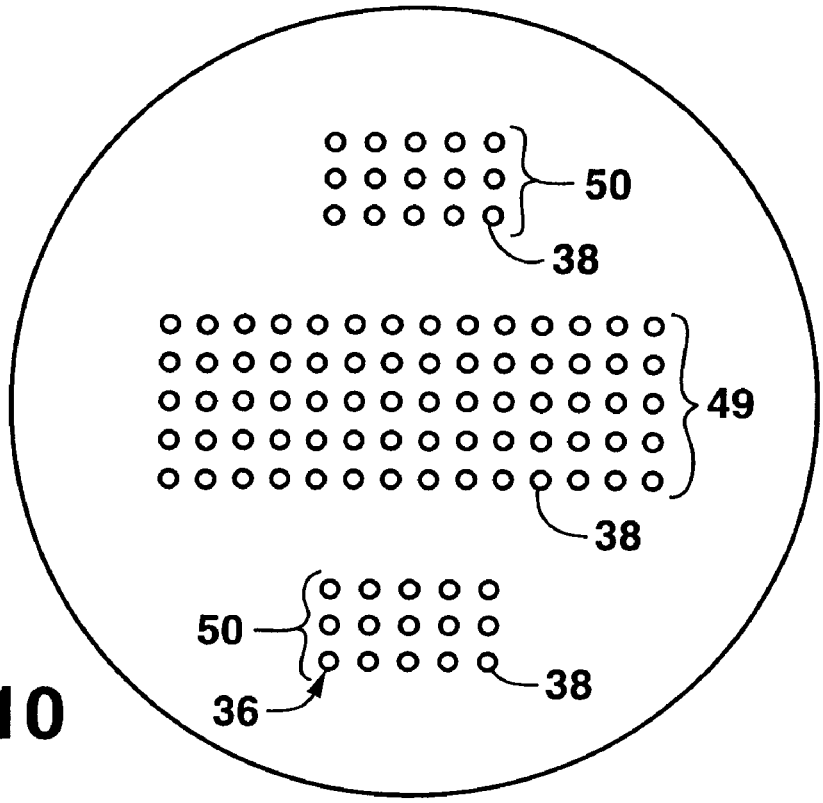
FIG. 10 is a front elevation of a round post face of the plug connector of FIGS. 2 and 4.
Figure 11:
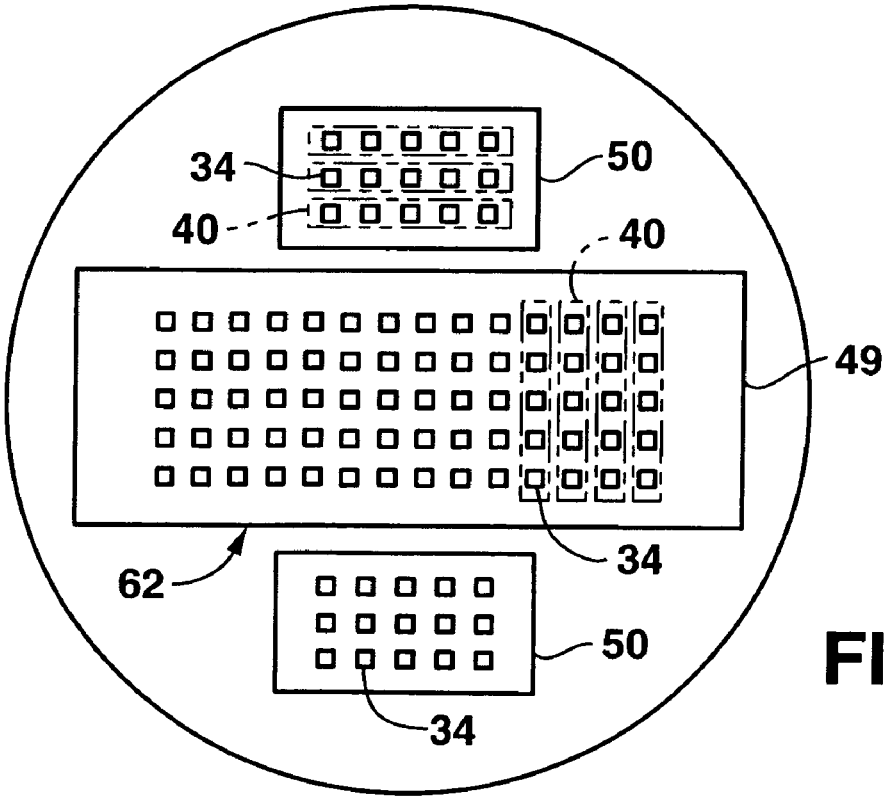
FIG. 11 is a front elevation of the square pin faces of the panel and plug connectors.
Figure 12:
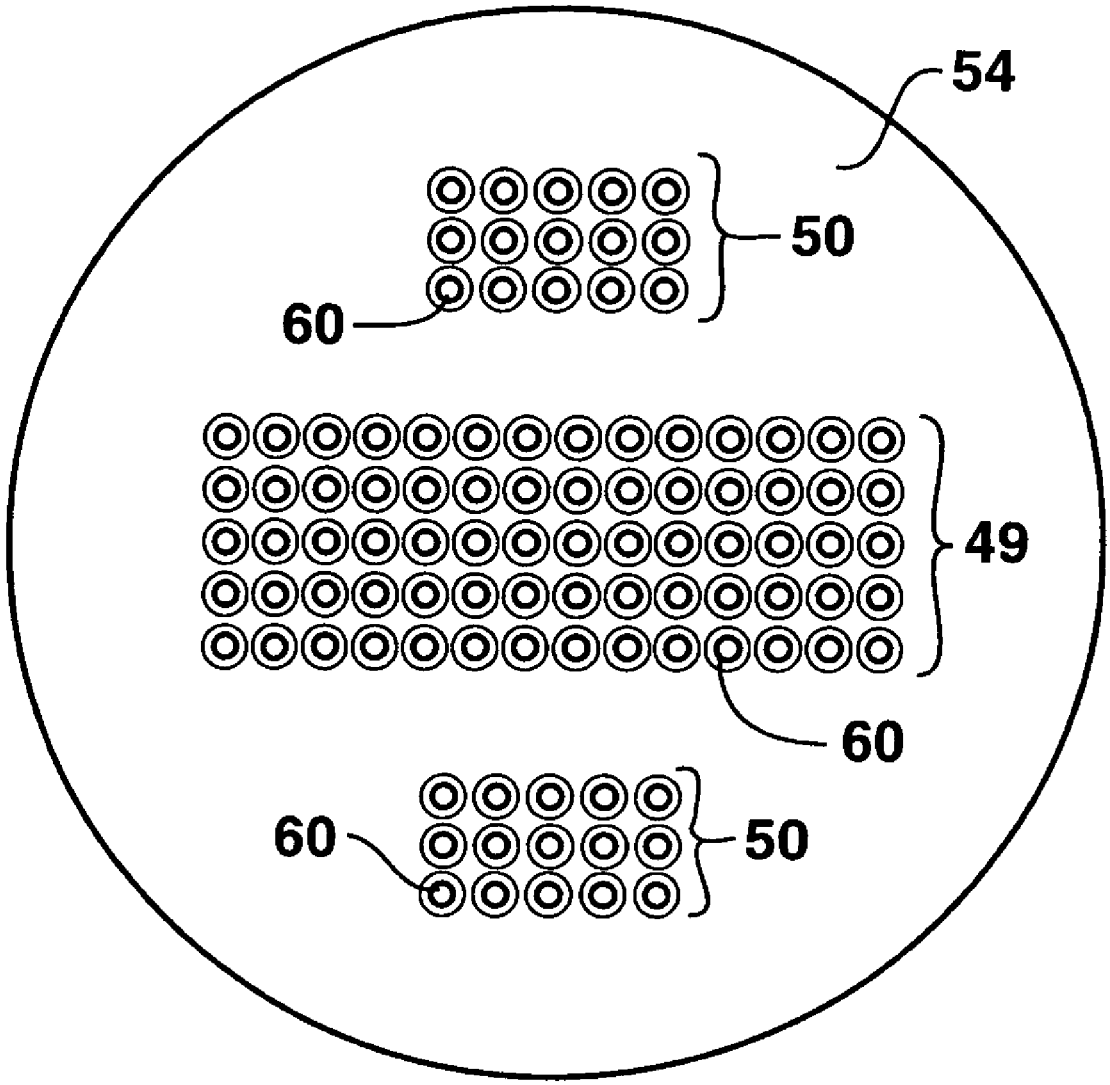
FIG. 12 is a front elevation of an array of post sockets of the plug connectors of FIGS. 5 and 6 according to the invention.

As can best be seen in FIGS. 3 and 4, panel connector B includes a first (rear) pin-face 30 and a second (front) pin-face 32. First pin-face 30 includes an array of square pins 34 which mate with cable connection 40. Second pin-face 32 includes a corresponding array 36 of round posts 38 which mate with sockets 60 of plug connector C (FIG. 6). As can best be seen, FIGS. 8A, 8B, and 9, square pins 34 and round posts 38 are preferably formed as one-piece, and are embedded in a resinous material 35 surrounded by a metal receptacle 37. In the illustrated embodiment, there are one hundred pins 34 and one hundred posts 38 in the pin/post arrays. Of course, it must be understood that the number of pins and the pattern of the arrays may vary depending on the application being made. The array of pins are designed to connect with cable connectors 40 terminating high speed electrical transmission cables, designated generally as 42. In the illustrated embodiment, each high speed transmission cable is illustrated as including a pair of parallel cables 44 and 46 (FIG. 3A). For example, cables 44, 46, may be shielded parallel pair cables available from Meritec, a division of Associated Enterprises, and marketed under the designation Model 700319-01, Style 2. Suitable cable connectors 40 are also available from Meritec. In this case, each cable includes two conductors and a ground. As can best be seen in FIG. 3B, the cable connectors terminate the two wires 44*a* and 44*b* of a first cable 44, and conductors 46*a* and 46*b* of second cable 46 with a common ground 48. Thus, as can best be seen in FIGS. 10–12, each of the corresponding arrays in the illustrated embodiment, includes a set 49 fourteen vertical rows of five sockets, posts, or pins, and two sets 50 of three horizontal rows of five sockets, pins, or posts. The five positions in each row correspond to the five contact socket positions of each connector 40. Thus, each array of pins, posts, and sockets, includes one hundred pins, posts, or sockets.

Figure 5:
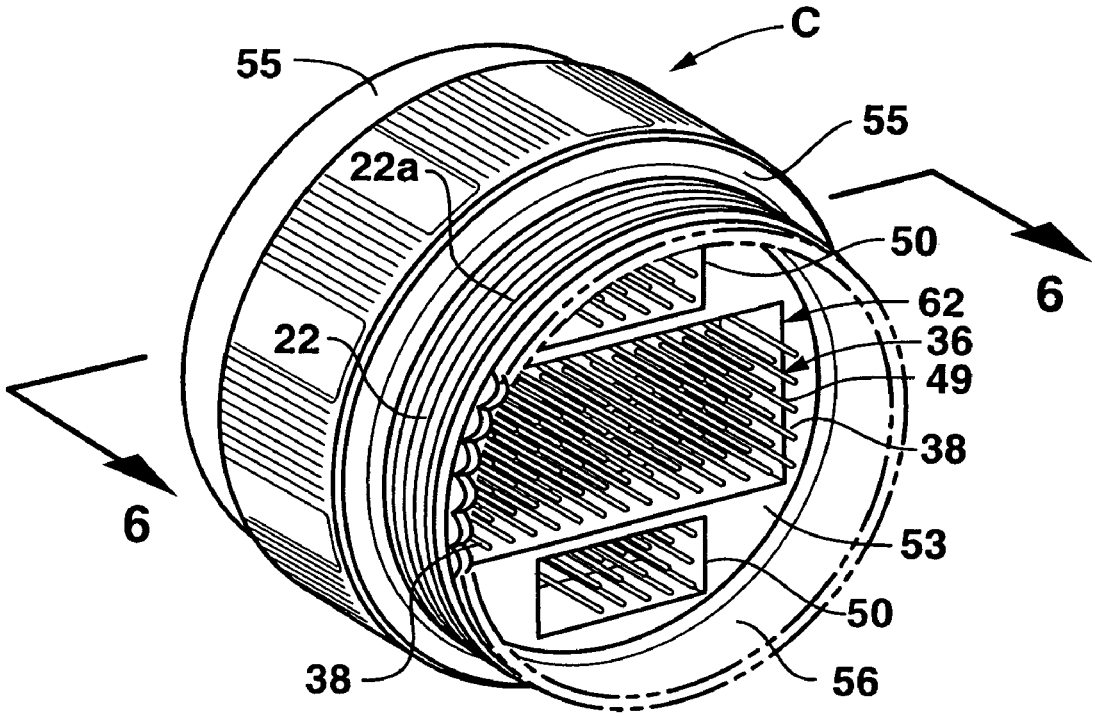
FIG. 5 is a front perspective view of a plug back of the plug connector illustrating an array of square-post pins according to the invention.

As can best be seen in FIGS. 5 and 6, plug connector C includes a connector plug, designated generally as 52. which has a plug front 54 and a plug back 56. Plug front 54 includes an array, designated generally as 58, of contact sockets 60. Contact sockets 60 receive round posts 38 of post array 36 of panel connector B. Plug back 56 includes a second pin array, designated generally as 62, of square pins 38. Connector plug 52 is formed with conductive sockets 60 and conductive pins 38 being electrically connected on the plug front and back respectively (FIG. 8). As in the case of panel connector B, sockets 60 and square pins 38 of second pin face 62 are preferable formed as one-piece, and are embedded in a resinous material 53 forming plug 52 and surrounded by a metal receptacle 55 (FIGS. 8A, 8B, and 9). It is noted above, a lock nut 24 mates with threads 22*a* of a threaded collar 22 of plug connector when the connectors are mated.

In an advantageous aspect of the invention, connector receptacles 35 and 53 may be receptacles used in standard MIL-C-38999 connectors, for example, those available from Deutsch Company of Hemet, Calif.

Referring now to FIG. 7, connector assembly A is illustrated wherein panel connector B and plug connector C are mated together. With the connectors mated, it can be seen that a first set of transmission cables 70 terminated to first pin array 36 may be placed in electrical communication with a second set 72 of transmission cables 70 connected to second pin array 62. In this manner, high speed data transmission signals may be transmitted across panel wall 10 to a remote electrical circuit (not shown).

Thus, it can be seen that an advantageous construction can be had for a panel connector assembly for interconnecting the printed circuit boards and the like of electrical circuits on opposing sides of a panel according to the invention wherein 2 mm cable connectors attached to the pins of the printed circuit boards on a first end of the cable assemblies may be utilized to terminate the cable assemblies to the input and output faces of connector receptacles mated together at the panel. In this manner, a larger number of high speed data transmission cables may be connected across the panel, in most cases up to twice as many, than the lower number of connections made possible by prior coaxial cables and connectors and a much more reliable connection may be had.

The connector design enables a standard 2 mm connector to mate within a M38999 style connector type III. The 2 mm connector is used as a means of interconnecting backplanes and printed circuit (PC) Boards within electronic enclosures. 2 mm connector systems house a variety of different wire constructions, typically coax lines, shielded wire constructions, parallel twisted pairs wire and others. Today, when circuit requirements are such that when a backplane or PC Board has wire constructions must exit the enclosure, special contacts are used to accomplish the transition to a bulkhead connector (receptacle) of some type. These contacts are expensive, labor intensive and requires special tooling. The 2 mm bulkhead connector (receptacle) has a mating connector (plug), which enables this connector to function as a "pass through" for high-speed data transmission cables without any degradation occurring to the signal line.

While a preferred embodiment of the invention has been described using specific terms, such description is for illustrative purposes only, and it is to be understood that changes and variations may be made without departing from the spirit or scope of the following claims.

What is claimed is:

1. A connector assembly for interconnecting high speed data transmission cables across an interface panel to transmit data signals from an internal circuit to an external circuit comprising:

an electrical panel connector adapted for mounting to said panel;

said panel connector having a first pin face for being disposed on a first side of said panel and a post face for being disposed on a second side of said panel when mounted;

a first pin array of conductive square pins carried by said first pin face of said panel connector, and a corresponding post array of conductive round posts carried by said post face of said panel connector;

an electrical plug connector for mating with said panel connector having a plug front and a plug back;

said plug front having an array of conductive post sockets corresponding to said array of round posts for receiving said posts when said post face of said panel connector and said plug front of said plug connector are mated together;

said plug back having a second pin array of said conductive square pins in electrical contact with said post sockets, said second pin array corresponding to said first pin array so that a first set of transmission cables electrically connected to said first pin array of said panel connector is electrically connected to a second set of transmission cables connected to said second pin array of said plug connector when said panel and plug connectors are mated;

whereby high speed transmission data may be transmitted across said panel to the external circuit by means of said first and second sets of transmission cables.

2. The system of claim 1 including a first cable assembly which includes said first set of transmission cables wherein each cable has an end terminated at a first cable connector which mates with a first group of square pins in said first pin array.

3. The system of claim 2 including a second cable assembly which includes said second set of transmission cables wherein each cable has an end terminated at a second cable connector which mates with a second group of square pins in said second pin array, and said first group and second group of square pins corresponding in position to interconnect corresponding conductors of said first and second set of cables.

4. The system of claim 3 wherein each cable of said first set of transmissions cables includes a third cable connector terminating an opposite end of said cable to the internal circuit, and each cable of said second set of cables includes a fourth cable connector terminating an opposite end of said cable to the external circuit.

5. The system of claim 4 wherein said first and second set of cables include 2 millimeter (2 mm) cables and said first, second, third, and fourth cable connectors include 2 mm cable connectors.

6. The system of claim 3 wherein each of said transmission cables of said first and second sets includes first and second conductors.

7. The system of claim 6 wherein said first and second conductors include a pair of parallel wires and a common ground terminated by said cable connector.

8. The system of claim 7 wherein each said cable connector includes a first pair of sockets for terminating said pair of wires of said first conductor, a second pair of sockets for terminating said pair of wires of said second conductors, and a ground socket for terminating said common grounds of said conductors.

9. The system of claim 3 wherein said square pins of said first electrical pin array and said round post in said post array are formed as one piece.

10. The system of claim 9 wherein said square pins in said second electrical pin array and said sockets of said socket array are formed as one piece within said plug connector.

11. The system of claim 1 wherein said panel connector includes a mounting flange for mounting said panel connector to said panel.

12. The system of claim 11 wherein said panel connector includes a threaded collar integral with said mounting flange, and said plug connector includes a threaded coupling which threadably mates with said threaded collar to fasten said panel connector and plug connector together when mated.

13. A connector assembly for interconnecting two millimeter (2 mm) high speed data transmission cables across an interface panel to transmit high speed data signals from an internal circuit to an external circuit comprising:

an electrical panel connector adapted for mounting to said panel having a first pin face for being disposed on a first side of said panel and a second pin face for being disposed on a second side of said panel when mounted;

a first pin array of conductive 2 mm pins carried by said first pin face of said panel connector, and a corresponding second pin array of conductive pins carried by said second pin face;

an electrical plug connector for mating with said panel connector having a plug front and a plug back;

said plug front having an array of conductive sockets corresponding to said second pin array of said panel connector for receiving said second pin array when said panel connector and said plug connector are mated together; and said plug back having a third pin array of conductive 2 mm pins in electrical contact with said conductive sockets, said third pin array corresponding to said first pin array so that a first set of 2 mm cables electrically connected to said first pin array of said panel connector is electrically connected to a second set of 2 mm cables connected to said third pin array of said plug connector when said panel and plug connectors are mated;

whereby high speed transmission data may be transmitted across said panel to the external circuit by means of said first and second sets of 2 mm cables.

14. The system of claim 13 including a first 2 mm cable assembly which includes said first set of 2 mm transmission cables wherein each cable has an end terminated at a first 2 mm cable connector which mates with a first group of 2 mm square pins in said first pin array.

15. The system of claim 14 including a second 2 mm cable assembly which includes said second set of 2 mm transmission cables wherein each cable has an end terminated in a second 2 mm cable connector which mates with a second group of square pins in said second pin array, and said first group and second group of square pins corresponding in position to interconnect corresponding conductors of said first and second set of 2 mm cables.

16. The system of claim 15 wherein each of said 2 mm transmission cables of said first and second sets includes first and second conductors.

17. The system of claim 16 wherein said first and second conductors of each set of 2 mm cables include a pair of parallel wires and a common ground terminated by said 2 mm cable connector.

18. The system of claim 13 wherein said pins of said first pin array and said pins in said second pin array are formed as one piece.

19. The system of claim 18 wherein said pins in said third pin array and said conductive sockets of said socket array are formed as one piece within said plug connector.

20. A connector assembly for interconnecting high speed data transmission cables across an interface panel to an external circuit to transmit high speed data comprising:

an electrical panel connector adapted for mounting to said panel;

a first pin array of conductive pins carried by an input face of said panel connector, and a corresponding second pin array of conductive pins carried by an output face of said panel connector;

an electrical plug connector for mating with said panel connector having a plug front and a plug back;

an array of conductive sockets corresponding to said second pin array carried by said plug front for receiving said second array of pins when said panel connector and said plug connector are mated together; and a third pin array of conductive pins carried by said plug back in electrical contact with said sockets, said third pin array corresponding to said first pin array so that a first set of transmission cables electrically connected to said first pin array of said panel connector is electrically connected to a second set of transmission cables connected to said third pin array of said plug connector when said panel and plug connectors are mated;

whereby high speed transmission data may be transmitted across said panel to external circuits by means of said first and second sets of transmission cables.

21. A method of transmitting high speed data signals from an internal circuit across an interface panel to an external electrical circuit using 2 mm transmission cable assemblies composed of 2 mm cables terminated at an end by 2 mm cable connectors, said method comprising:

connecting a first set of said 2 mm cable assemblies to a first pin array of square pins carried by an electrical panel connector mounted to said panel wherein said first pin array is disposed on one side of said panel;

connecting a second set of said 2 mm cable assemblies to a second pin array of square pins carried by a plug connector mated to said panel connector on an opposing side of said panel wherein said first and second pin arrays correspond to each other; and terminating opposing ends of said first and second sets of 2 mm cable assemblies to said internal and external electrical circuits, respectively.

22. The method of claim 21 including connecting said first and second cable assemblies to said internal and external circuits by terminating said opposing ends of said 2 mm cable assemblies using 2 mm cable connectors.

* * * * *